US005286223A

United States Patent [19]

Ogawa

[11] Patent Number: 5,286,223

[45] Date of Patent: Feb. 15, 1994

[54] SOCKET FOR WEDGE BASE BULB

[75] Inventor: Shinji Ogawa, Yokkaichi, Japan

[73] Assignee: Sumitomo Wiring Systems, Ltd., Yokkaichi, Japan

[21] Appl. No.: 981,311

[22] Filed: Nov. 25, 1992

[30] Foreign Application Priority Data

Nov. 30, 1991 [JP] Japan ..... 3-099014[U]
Nov. 30, 1991 [JP] Japan ..... 3-099015[U]
Dec. 20, 1991 [JP] Japan ..... 3-105533[U]

[51] Int. Cl.[5] ..... H01R 19/00
[52] U.S. Cl. ..... 439/619; 439/699
[58] Field of Search ..... 439/699, 611-619, 439/356, 360, 56, 217, 220, 223

[56] References Cited

U.S. PATENT DOCUMENTS 4,114,972 9/1978 Kraus et al. ..... 439/699
4,412,716 11/1983 Baba et al. ..... 439/699
4,610,497 9/1986 Tsuchida et al. ..... 439/699
4,795,373 1/1989 Fitzgerald et al. .
4,804,343 2/1989 Reedy et al. ..... 439/699
4,957,455 9/1990 Horiuchi et al. ..... 439/548

FOREIGN PATENT DOCUMENTS 931324 7/1963 United Kingdom .
2220111A 12/1989 United Kingdom .

*Primary Examiner*—David L. Pirlot
*Attorney, Agent, or Firm*—Sughrue, Mion, Zinn, Macpeak & Seas

[57] ABSTRACT

A socket for a wedge base bulb, in which a cylindrical socket body has an opening for receiving the bulb and a terminal having a pair of opposed contact pieces is mounted in the opening and the contact pieces grip a base portion of the bulb therebetween so as to be electrically connected to the base portion, the improvement comprising: a slot for receiving a rectangular platelike mounting portion of the terminal, which is formed on an inner face of a circumferential wall of the socket body so as to confront the opening; a step portion which projects radially inwardly from an axially lower location of the inner face of the circumferential wall in the slot; wherein when the bulb has a minimum size, the bulb is supported by a lower portion of the mounting portion of the terminal; and wherein when the bulb has a maximum size, an upper portion of the mounting portion of the terminal is deflected radially outwardly by the bulb about a fulcrum defined by an upper edge of the step portion of the slot so as to grip the bulb.

7 Claims, 19 Drawing Sheets

Fig. 17
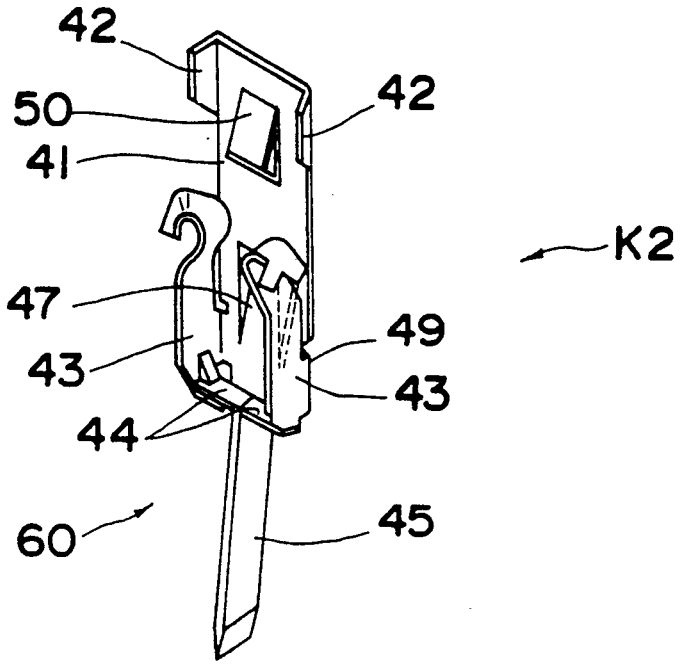
Fig. 18 (K2)
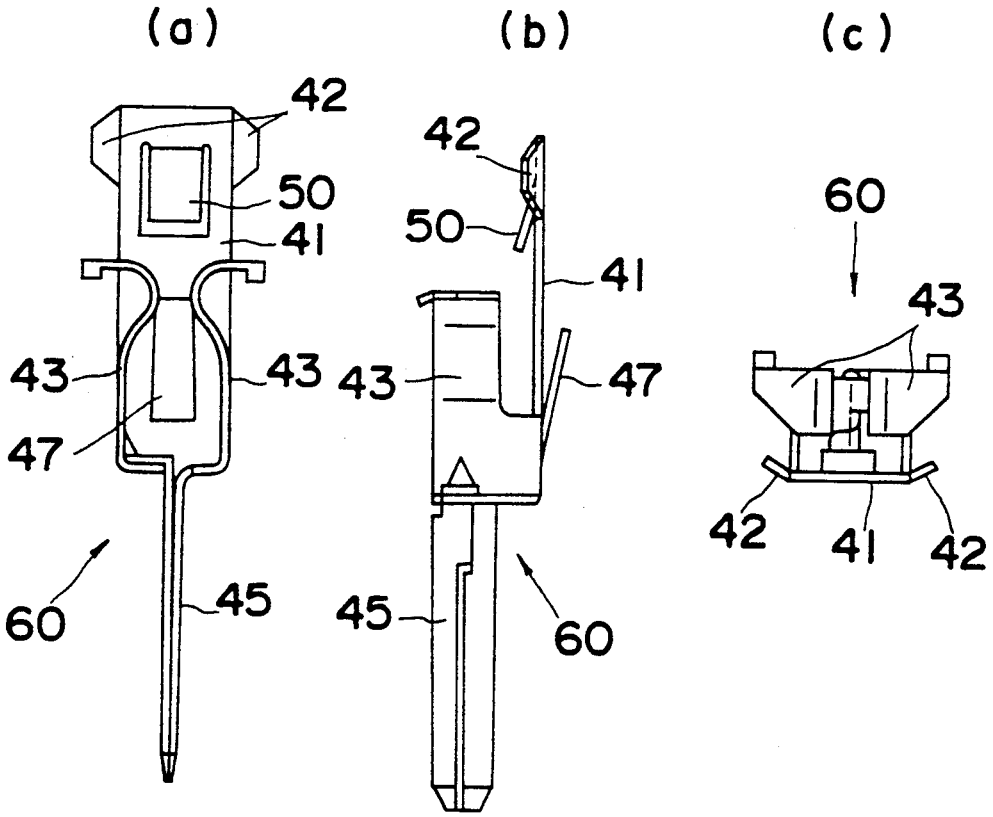

Fig. 23
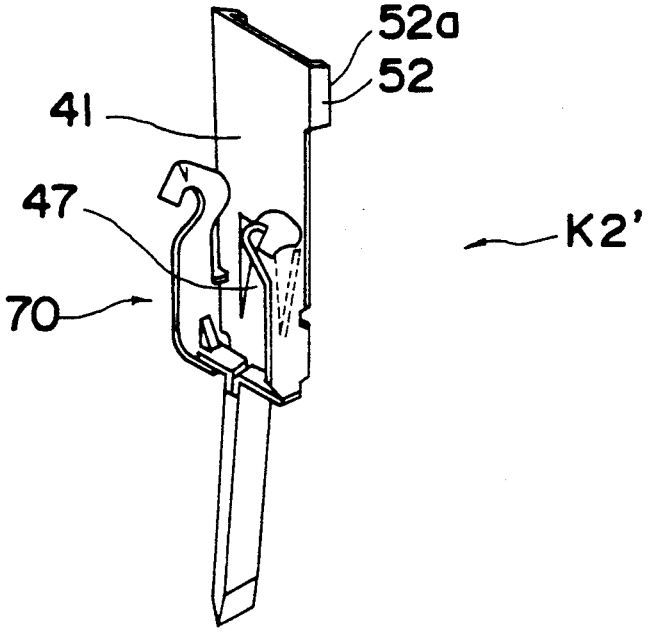
Fig. 24 (K2')
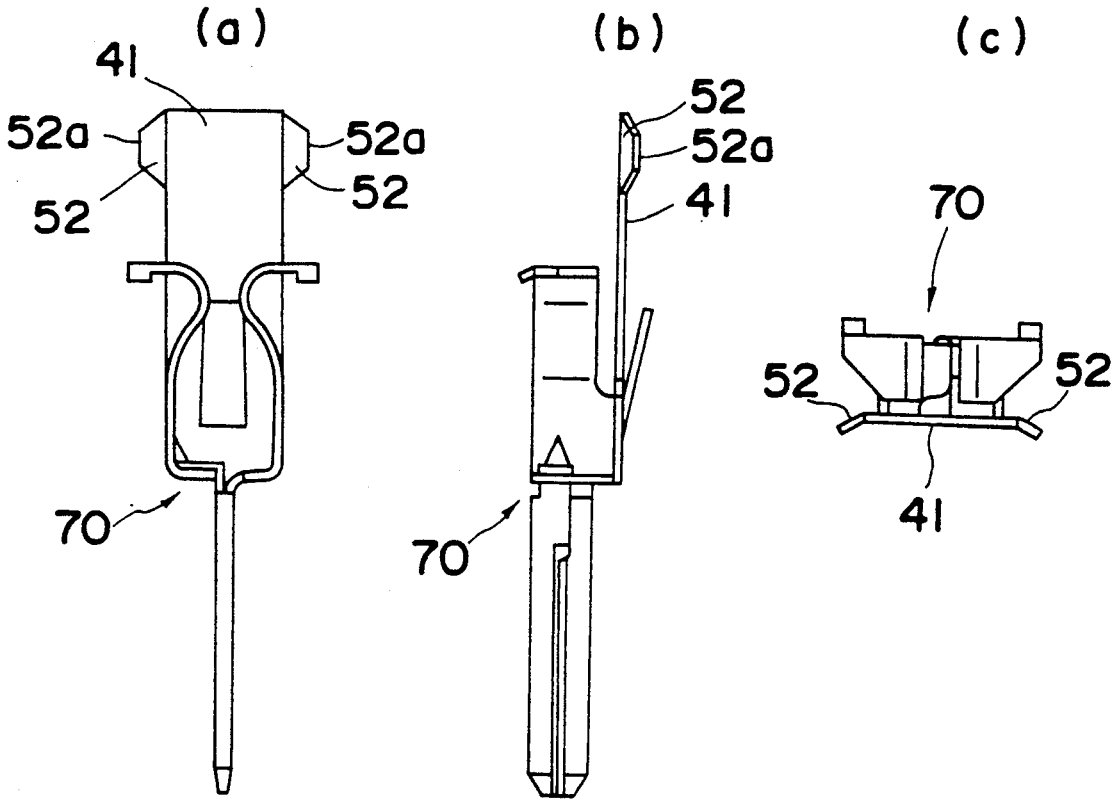

Fig. 29 (K3)

SOCKET FOR WEDGE BASE BULB

BACKGROUND OF THE INVENTION

The present invention relates to a socket for a wedge base bulb used as a lamp for a motor vehicle, etc., which eliminates not only looseness of the bulb fitted into the socket but at the time of improper insertion of the bulb into the socket, deformation of a terminal mounted in the socket.

In a known socket for a wedge base bulb 6 as shown in FIGS. 1 and 2, a substantially I-shaped opening 2 for receiving the bulb 6 is formed in a cylindrical socket body 1 and terminals 3A and 3B each having a pair of contact pieces 4 are symmetrically fitted into the opening 2 so as to interpose a central bore 5 therebetween such that the contact pieces 4 of the terminal 3A confront the contact pieces 4 of the terminal 3B, respectively. Furthermore, in the socket body 1, ribs 13A to 13F project radially inwardly from an inner face of a circumferential wall 12 into the opening 2 and are spaced circumferentially from each other. Radially inner faces of the ribs 13A to 13F are so formed as to define a circle.

As shown in FIG. 3, the bulb 6 has a glass globe 7, a pair of base portions 8 provided at a bottom of the glass globe 7 and a cylindrical stem 9 extending between the base portions 8. Each of the base portions 8 is formed with a recess **8*a* such that lead wires 10A and 10B project from the recesses 8*a*, respectively. When the bulb 6 is fitted into the known socket, not only each of the base portions 8 is positioned between the contact pieces 4 of each of the terminals 3A and 3B mounted in the socket body 1 but the stem 9 is positioned at the central bore 5 such that the bulb 6 is inserted into the opening 2. Then, each of the base portions 8 is gripped between the contact pieces 4 of each of the terminals 3A and 3B such that the bulb 6 is clamped. As a result, each of the lead wires 10A and 10B is brought into contact with one of the contact pieces 4 of each of the terminals 3A and 3B**.

Meanwhile, a hole 12 for receiving a connector (not shown) is formed at one end of the terminal body 1 remote from the opening 2. As shown in FIG. 2, a connector contact 12 extends downwardly from the contact pieces 4 of each of the terminals 3A and 3B and protrudes into the hole 12 so as to be connected to the connector fitted into the hole 12.

In the bulbs of this kind, an outside diameter D1 (FIG. 3(a)) of the glass globe 7 is stipulated by the Japanese Industrial Standards (JIS) so as not to exceed 10.29 mm. However, a minimum value of the outside diameter D1 of the glass globe 7 has not been stipulated by JIS. The glass globe 7 of 9.60 to 10.20 mm in outside diameter is usually used. However, diameter of the opening 2 for receiving the bulb 6 should be set such that the bulb 6 having the glass globe 7 of 10.29 mm in outside diameter can be inserted into the opening 2. Therefore, as shown by the broken lines in FIGS. 1 and 2, diameter of the opening 2 is set on the basis of the maximum value of 10.29 mm in the outside diameter D1. Namely, it is so arranged that the radially inner faces of the ribs 13A to 13F are brought into contact with the outer peripheral surface of the glass globe 7 having the maximum value of 10.29 mm in the outside diameter D1 so as to hold the glass globe 7.

Therefore, in case the glass globe 7 of the bulb 6 to be fitted into the opening 2 has the maximum value of 10.29 mm in the outside diameter D1, the glass globe 7 is brought into contact with the radially inner faces of the ribs 13A to 13F of the socket body 1 without any clearance therebetween, so that the glass globe 7 is not set loose in the opening 2 even when vibrations are applied to the motor vehicle.

However, in case the outside diameter D1 of the glass globe 7 of the bulb 6 is less than the maximum value of 10.29 mm, for example, the outside diameter D1 of the glass globe 7 is 9.60 mm, a clearance G of about 0.35 mm is formed between the glass globe 7 and each of the radially inner faces of the ribs 13A to 13F as shown in FIG. 4. Therefore, if vibrations in the direction of the arrow shown in FIG. 5 are applied to the known socket, the glass globe 7 is set loose in the socket body 1 due to the clearance G, thereby resulting in detachment of the bulb 6 from the socket body 1 or deterioration of reliability of electrical contact between the lead wires 10A and 10B of the bulb 6 and the terminals 3A and 3B.

As shown in FIG. 6, a pair of parallel walls 15 confront each other in the opening 2 so as to support the contact pieces 4 of each of the terminals 3A and 3B such that an upper end **4*a* of each of the contact pieces 4 of each of the terminals 3A and 3B extends above an upper end 15*a* of each of the parallel walls 15. Therefore, if the bulb 6 is improperly inserted into the opening 2, for example, obliquely as shown by the arrow Al or at a location far distant from the axis of the opening 2 as shown by the arrow A2 when the bulb 6 is fitted into the socket body 1, such an undesirable phenomenon may take place that the base portions 8 of the bulb 6 interfere with or depress the upper end 4*a* of one of the contact pieces 4 so as to deform the contact piece 4 as shown by the two-dot chain lines in FIG. 6. Once the contact piece 4 has been deformed due to improper insertion of the bulb 6 into the opening 2 of the socket body 1, the bulb 6 cannot be fitted into the socket body 1 smoothly even if the bulb 6 is properly inserted into the opening 2** subsequently.

SUMMARY OF THE INVENTION

Accordingly, an essential object of the present invention is to provide a socket for a wedge base bulb, in which even if a glass globe of the bulb has any outside diameter ranging from a minimum of 9.60 mm to a maximum of 10.29 mm, the bulb fitted into a socket body is not set loose without any clearance therebetween.

Another important object of the present invention is to provide a socket for a wedge base bulb, in which even when a base portion of the bulb bumps against a terminal in a socket body due to insertion of the bulb into the socket body in an improper direction, deformation of the terminal can be prevented.

In order to accomplish the first object of the present invention, there is provided a socket for a wedge base bulb, according to one embodiment of the present invention, in which a cylindrical socket body has an opening for receiving the bulb and a terminal having a pair of opposed contact pieces is mounted in the opening and the contact pieces grip a base portion of the bulb therebetween so as to be electrically connected to the base portion, the improvement comprising: a slot for receiving a rectangular platelike mounting portion of the terminal, which is formed on an inner face of a circumferential wall of the socket body so as to confront the opening; a step portion which projects radially inwardly from a location of the inner face of the circumferential wall in the slot; the location, in case an axis of the socket body extends in a vertical direction such that the opening is disposed at an upper portion of the socket body, being axially spaced from an upper end of the circumferential wall such that the step portion confronts a lower portion of the mounting portion when the mounting portion has been fitted into the slot; wherein when the bulb has a minimum size, the bulb is supported by the lower portion of the mounting portion of the terminal; and wherein when the bulb has a maximum size, an upper portion of the mounting portion of the terminal is deflected radially outwardly by the bulb about a fulcrum defined by an upper edge of the step portion of the slot so as to grip the bulb.

In the one embodiment of the present invention, a portion of the inner face of the circumferential wall, which defines the slot for receiving the mounting portion of the terminal, is divided into a central portion confronting a central portion of the mounting portion and opposite side portions confronting opposite side portions of the mounting portion, respectively such that the opposite side portions project, as the step portions, radially inwardly further than the central portion. Since each of the step portions is disposed at a lower portion of each of the opposite side portions, the upper portion of each of the opposite side portions of the mounting portion of the terminal is deflected by each of the step portions.

In the one embodiment of the present invention, mounting position of the terminal is set in accordance with the minimum size of the bulb as described above. Therefore, when the bulb having the minimum size has been fitted into the socket, the bulb is not set loose. On the other hand, when the bulb having the maximum size has been fitted into the socket, the upper portion of the mounting portion of the terminal is deflected by the step portion so as to support the bulb and thus, the bulb having the maximum size can also be fitted into the socket without being set loose.

Meanwhile, in order to accomplish the second object of the present invention, there is provided a socket for a wedge base bulb, according to another embodiment of the present invention, in which a cylindrical socket body has an opening for receiving the bulb and a terminal having a pair of opposed contact pieces is mounted in the opening and the contact pieces grip the a base portion of the bulb therebetween so as to be electrically connected to the base portion, the improvement comprising: the contact pieces each having a distal end portion such that the distal end portions of the contact pieces extend in opposite outward directions, respectively; a pair of projections which are bent from the distal end portions of the contact pieces, respectively; the socket body being formed with a pair of engageable portions engageable with the projections, respectively such that each of the engageable portions has a width larger than that of each of the projections; the projections each having opposite end faces in a direction of the width of each of the projections, while each of the engageable portions has opposed end faces in a direction of the width of each of the engageable portions; and wherein when each of the projections is inserted into each of the engageable portions, either one of the end faces of each of the projections is brought into contact with a corresponding one of the end faces of each of the engageable portions during displacement of the contact pieces of the terminal such that deformation of the terminal is restrained.

In the latter embodiment of the present invention, each of the projections of the terminal is so formed as to protrude towards an axis of the socket body downwardly obliquely or horizontally, while each of the engageable portions of the socket body is obtained by a groove formed on an upper end face of each of a pair of parallel opposed walls of the socket body such that each of the projections can be inserted into each of the groove with a certain clearance formed therebetween in the direction of the width of each of the projections.

Alternatively in the latter embodiment of the present invention, each of the projections of the terminal is obtained by downwardly bending the distal end portion of each of the contact pieces, while each of the engageable portions of the socket body is obtained by a gap formed on each of the parallel opposed walls.

As described above, in the latter embodiment of the present invention, each bent projection is formed integrally with the distal end portion of each of the contact pieces and each engageable portion for loosely receiving the projection is formed in the socket body. Therefore, even when the bulb is inserted into the socket body in an improper direction, for example, obliquely relative to the socket body and the terminal is displaced due to contact of the base portion of the bulb with the contact piece of the terminal, either one of the end faces of the projection in the direction of the width of the projection is brought into contact with a corresponding one of the end faces of the engageable portion in the direction of the width of the engageable portion, so that displacement of the contact piece is prevented and thus, deformation of the terminal is restrained.

BRIEF DESCRIPTION OF THE DRAWINGS

These objects and features of the present invention will become apparent from the following description taken in conjunction with the preferred embodiments thereof with reference to the accompanying drawings, in which:

FIG. 17 is a perspective view of a terminal of the socket of FIG. 15;

FIGS. 18(*a*), 18(*b*) and 18(*c*) are a front elevational view, a side elevational view and a top plan view of the terminal of FIG. 17, respectively;

FIG. 23 is a perspective view of a terminal of a socket which is a modification of the socket of FIG. 15;

FIGS. 24(*a*), 24(*b*), and 24(*c*) are a front elevational, a side elevational and a top plan view of the terminal of FIG. 23, respectively;

Before the description of the present invention proceeds, it is to be noted that like parts are designated by like reference numerals throughout several views of the accompanying drawings.

DETAILED DESCRIPTION OF THE INVENTION

Figure 1:
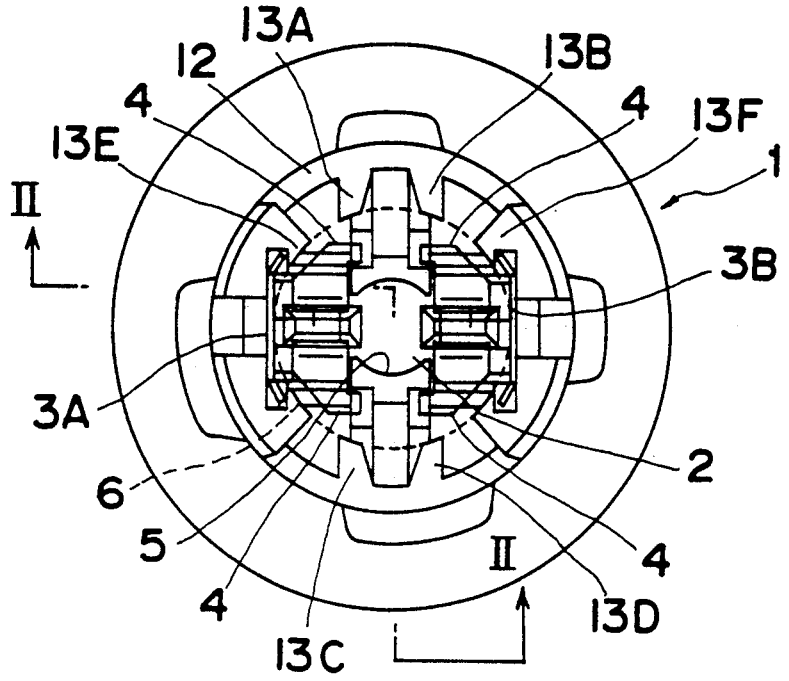
Fig. 1 PRIOR ART
FIG. 1 is a top plan view of a prior art socket for a wedge base bulb (already referred to)
Figure 2:
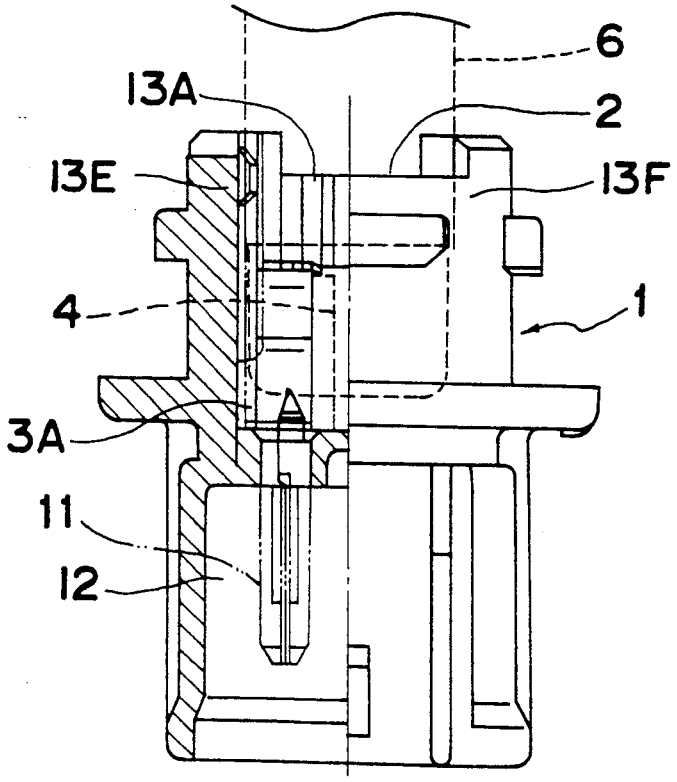
Fig. 2 PRIOR ART
FIG. 2 is a sectional view taken along the line II—II in FIG. 1 (already referred to)
Figure 3:
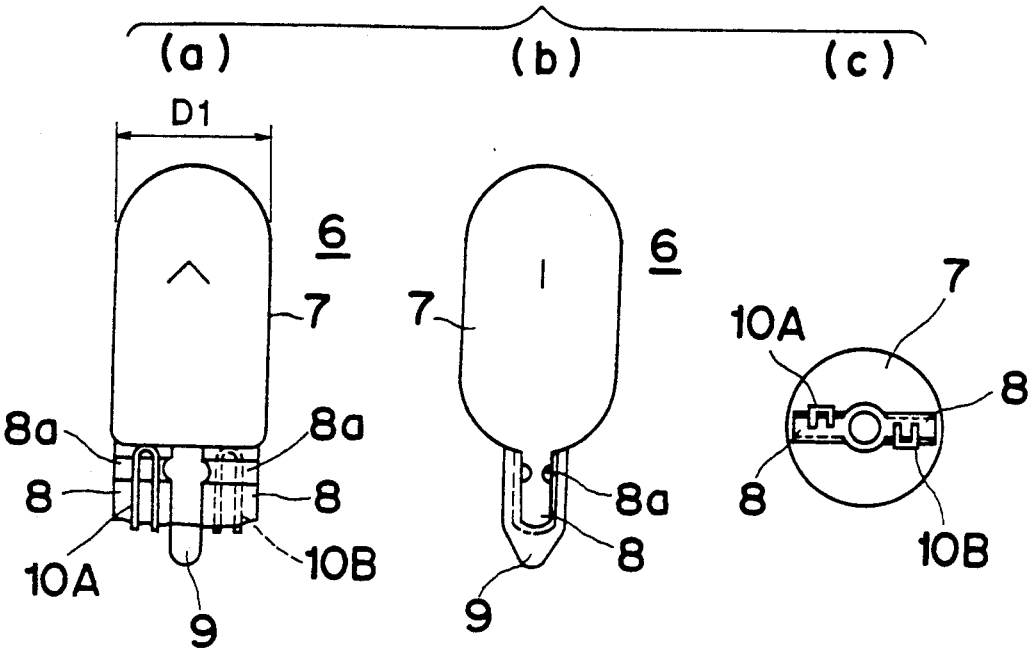
Fig. 3 PRIOR ART
FIG. 3 is a front elevational view, a side elevational view and a bottom plan view of a prior art bulb, respectively (already referred to)
Figure 4:
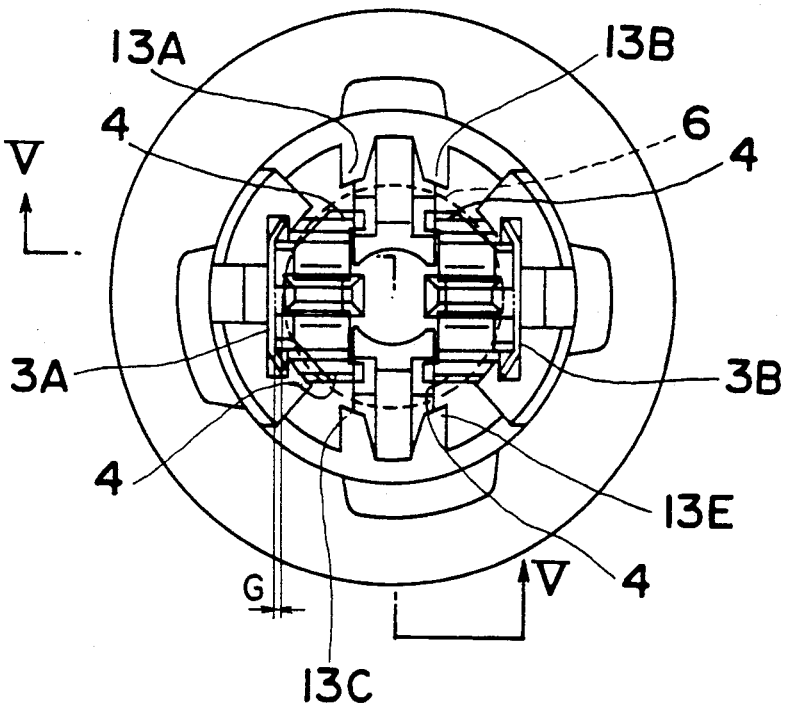
Fig. 4 PRIOR ART
FIG. 4 is a top plan view showing a problem of the prior art socket of FIG. 1 (already referred to)
Figure 5:
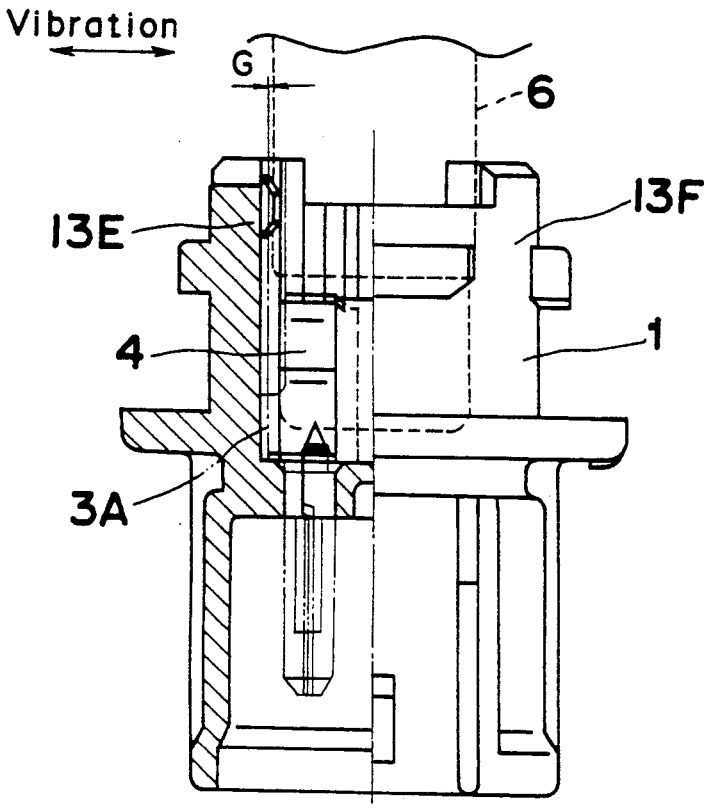
Fig. 5 PRIOR ART
FIG. 5 is a sectional view taken along the line V—V in FIG. 4 (already referred to)
Figure 6:
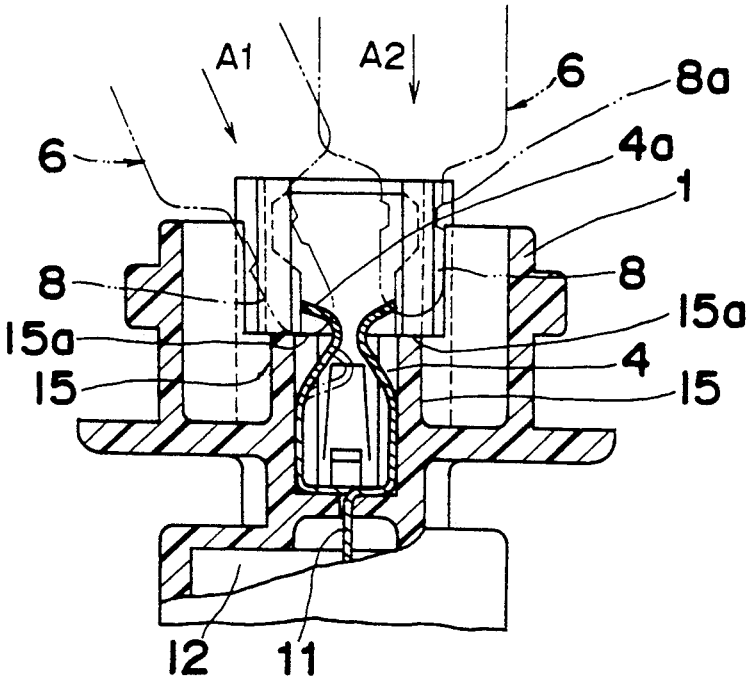
Fig. 6 PRIOR ART
FIG. 6 is a sectional view showing another problem of the prior art socket of FIG. 1 (already referred to)
Figure 7:
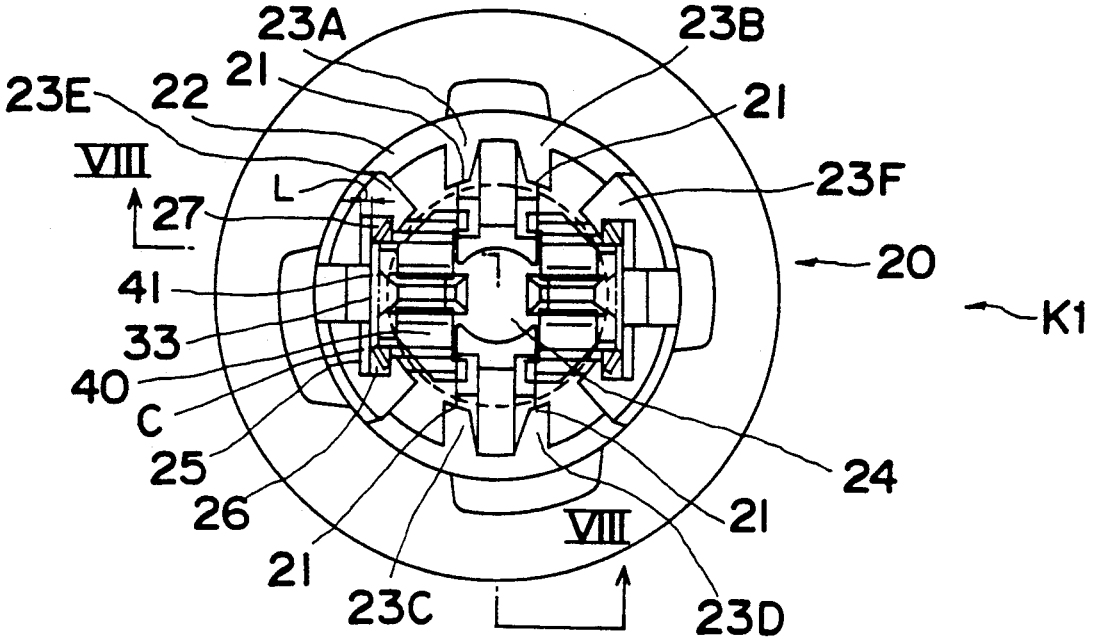
FIG. 7 is a top plan view of a socket for a wedge base bulb, according to a first embodiment of the present invention.

Referring now to the drawings, there is shown in FIGS. 7 to 14, a socket K1 for a wedge base bulb 6, according to a first embodiment of the present invention. It should be noted that the bulb 6 employed in the present invention is the same as a prior art bulb 6 shown in FIG. 3. Therefore, as shown in FIG. 3(*a*), a glass globe 7 of the bulb 6 has an outside diameter D1 ranging from a minimum value of 9.60 mm to a maximum value of 10.29 mm. The socket K1 includes a cylindrical socket body 20 made of electrically insulating resin. An opening 24 for receiving the bulb 6 is defined by an inner face of a circumferential wall 22 of the socket body 20. Furthermore, ribs 23A to 23F project radially inwardly from the inner face of the circumferential wall 22 into the opening 24 and are spaced circumferentially a predetermined distance from each other. Radially inner faces 21 of the ribs 23A to 23F are so formed as to define a circle and thus, are brought into contact with an outer peripheral surface of the glass globe 7 of the bulb 6. Diameter of the circle defined by the radially inner faces 21 of the ribs 23A to 23F is so set as to correspond to the maximum value of 10.29 mm in the outside diameter D1 of the glass globe 7.

Figure 9:
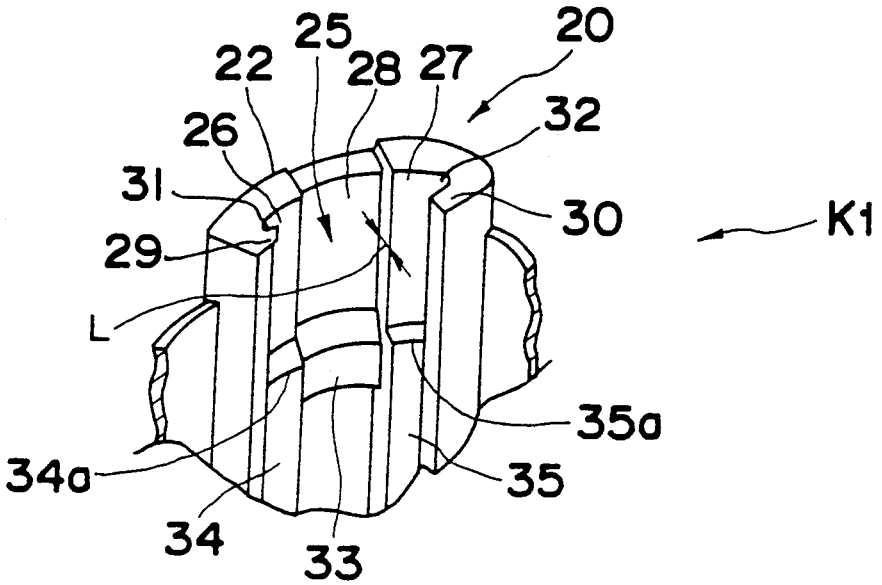
FIG. 9 is an enlarged fragmentary perspective view of a socket body of the socket of FIG. 7.
Figure 10:
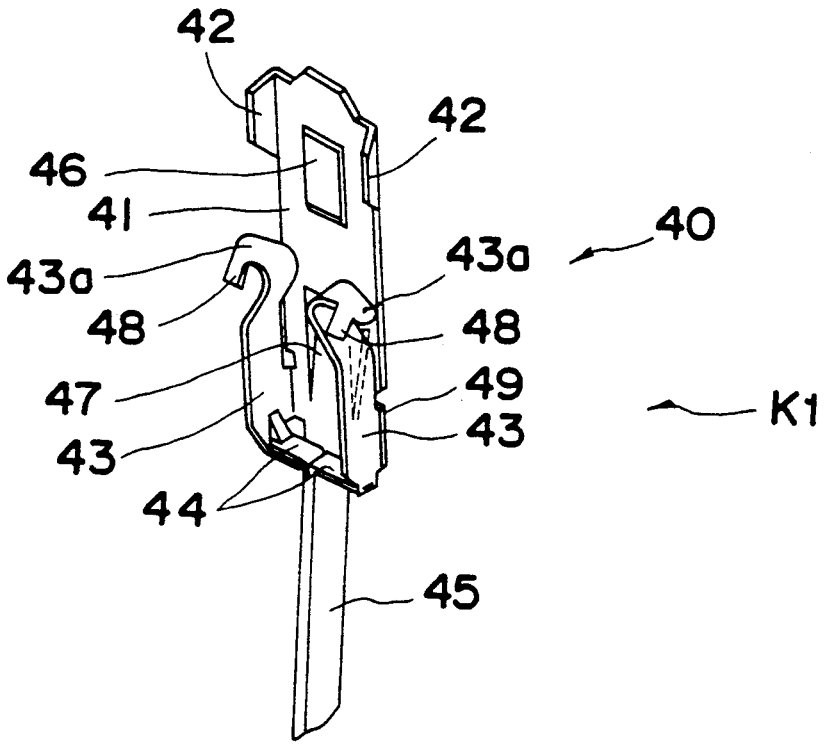
FIG. 10 is a perspective view of a terminal of the socket of FIG. 7.
Figure 11:
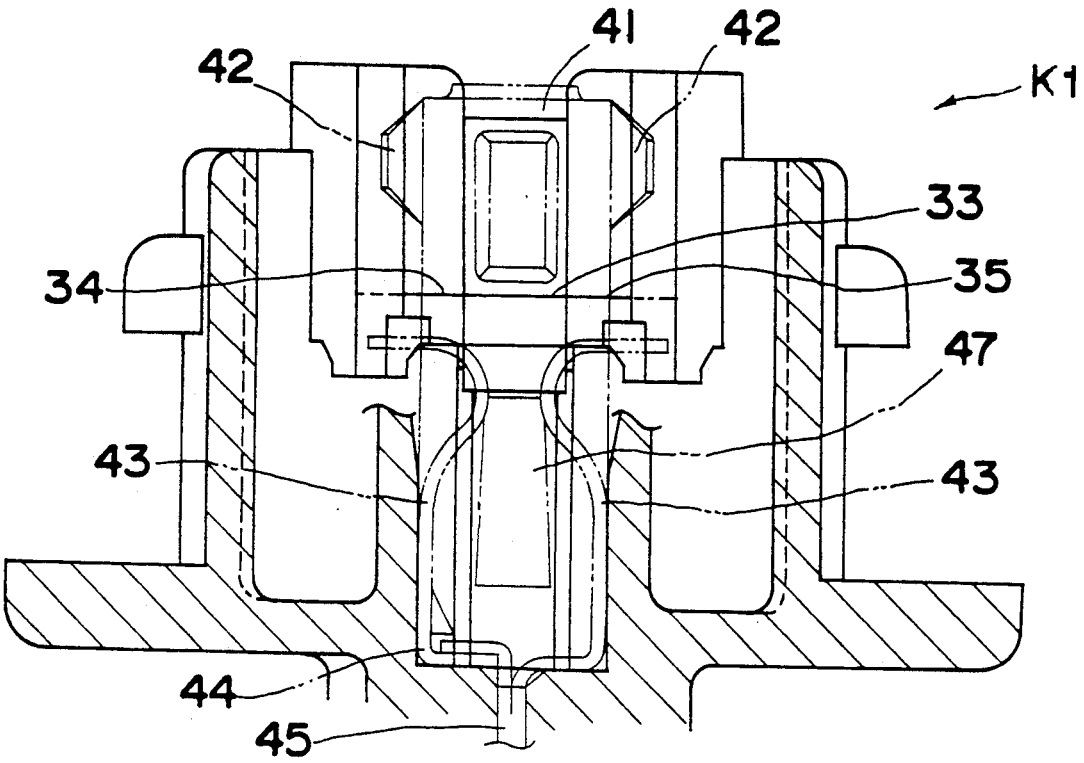
FIG. 11 is an enlarged sectional view showing mounting of the terminal of FIG. 10 on the socket body of FIG. 9.

A pair of axial slots 25 are, respectively, formed at diametrically opposed locations on the inner face of the circumferential wall 22 such that a rectangular platelike mounting portion 41 of a terminal 40 shown in FIG. 10 is inserted into each of the slots 25. As shown in FIG. 9, each of the slots 25 is circumferentially divided into opposite side portions 26 and 27 and a central portion 28 between the side portions 26 and 27. At the central portion 28, the peripheral surface of the slot 25 confronts a central portion of the mounting portion 41 of the terminal 40. Meanwhile, at the side portions 26 and 27, the peripheral surface of the slot 25 confronts opposite side portions of the mounting portion 41 of the terminal 40. A substantially L-shaped hooked portion 29 is formed at one side of the side portion 26 remote from the central portion 28 so as to form a cavity 31 and likewise, a substantially L-shaped hooked portion 30 is formed at one side of the side portion 27 remote from the central portion 28 so as to form a cavity 32 such that a pair of lugs 42 projecting from opposite side edges of an upper portion of the mounting portions 41 are engaged with the cavities 31 and 32, respectively.

The side portions 26 and 27 project radially inwardly through a distance L from the central portion 28 such that the inner face of the circumferential wall 22 at the central portion 28 is radially recessed from that at the side portions 26 and 27. A protrusion 33 is formed at an axially inner location of the central portion 28. At the side portions 26 and 27, radially inwardly projecting step portions 34 and 35 are formed on the inner face of the circumferential wall 22 axially downwardly from the same axial location of the side portions 26 and 27 as the protrusion 33. The step portions 34 and 35 have upper edges 34*a* and 35*a*, respectively.

Figure 8:
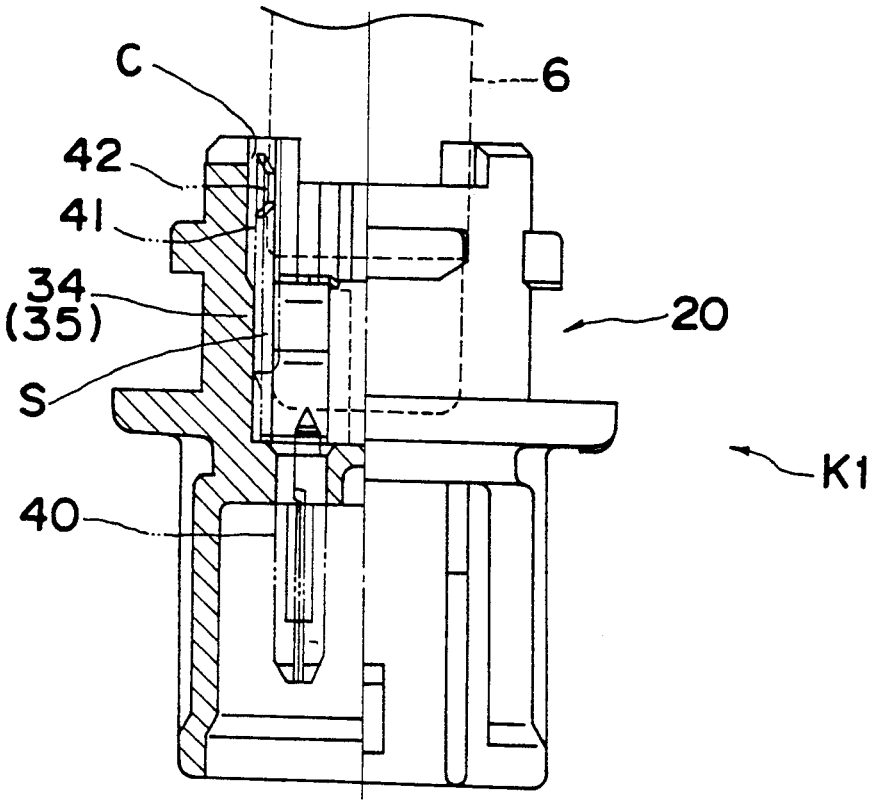
FIG. 8 is a sectional view taken along the line VIII—VIII in FIG. 7.

At a substantially longitudinally central portion of the mounting portion 41 inserted into the slot 25, the rear face of the mounting portion 41 is brought into contact with the protrusion 33. Meanwhile, opposite side portions of the rear face of the mounting portion 41 are brought into contact with the step portions 34 and 35, respectively. Therefore, at an axially outer location of the socket body 20 above the protrusion 33 and the step portions 34 and 35, a clearance C is formed between the mounting portion 41 and the inner face of the circumferential wall 22 as shown in FIG. 8.

Mounting positions of the mounting portion 41 of the terminal 40 are regulated by the protrusion 33 and the step portions 34 and 35 of the slot 25. The upper portion of the mounting portion 41 is set in accordance with the minimum value of 9.60 mm in the outside diameter D1 of the glass globe 7 of the bulb 6 and is brought into contact with an outer peripheral surface of the glass globe 7 having the minimum value of 9.60 mm in the outside diameter D1 so as to hold the glass globe 7. As shown in FIG. 3(*a*), an outer edge of each of base portions 8 of the bulb 6 is disposed slightly laterally inwardly from an outer peripheral surface of the glass globe 7. Therefore, when the glass globe 7 of the bulb 6 has the minimum value of 9.60 mm in the outside diameter D1, there is a slight gap S between the outer edge of each of the base portions 8 and the mounting portion 41 of the terminal 40 as shown in FIG. 8. On the contrary, when the glass globe 7 has the maximum value of 10.29 mm in the outside diameter D1, the outer edge of each of the base portions 8 is adapted to come into contact with the mounting portion 41.

As shown in FIG. 10, the terminal 40 is formed by blanking and bending an electrically conductive metal plate. A pair of contact pieces 43 each having a bottom portion 44 are formed at opposite side edges of a lower portion of the mounting portion 41, respectively. Meanwhile, a pair of the lugs 42 project from the opposite side edges of the upper portion of the mounting portion 41 as described earlier. The contact pieces 43 and the lugs 42 project from one face of the mounting portion 41 so as to confront the axis of the socket body 20 when the terminal 40 is mounted in the socket body 20.

Furthermore, a connector contact 45 extends downwardly from a central joint between the bottom portions 44 of the contact pieces 43. Each of the contact pieces 43 has a coupling portion 49 coupled with a lower end portion of the mounting portion 41 and the contact pieces 43 are bent from the coupling portions 49 orthogonally to the mounting portion 41. Upper end portions of the contact pieces 43 are curved towards each other and then, are bent outwardly away from each other such that flexibility is imparted to a distal end portion 43*a* of each of the contact pieces 43.

Furthermore, a projection 48 is bent obliquely downwardly from the distal end portion 43*a*. A boss 46 is formed at an upper central portion of the mounting portion 41 so as to project in the same direction as the contact pieces 43 and the lugs 42. The boss 46 has a function of eliminating looseness of the bulb 6 inserted into the socket body 20. In addition, a rectangular stopper 47 is cut and obliquely bent from a lower central portion of the mounting portion 41 so as to project in the direction opposite to that of the boss 46. When the terminal 40 has been mounted in the opening 24 of the socket body 20, the stopper 47 is brought into engagement with a lower face of the protrusion 33 of the slot 25 of the socket body 20 so as to prevent detachment of the terminal 40 from the socket body 20.

In the socket K1 of the above described arrangement, when the bulb 6 provided with the glass globe 7 having the minimum value of 9.60 mm in the outside diameter D1 has been fitted into the socket body 20, the mounting portion 41 of each of the terminals 40 is brought into contact with the outer peripheral surface of the glass globe 7 of the bulb 6. Thus, the bulb 6 is closely gripped between the mounting portions 41 in the slots 25 of the socket body 20 so as to be closely held by the mounting portions 41.

Figure 12:
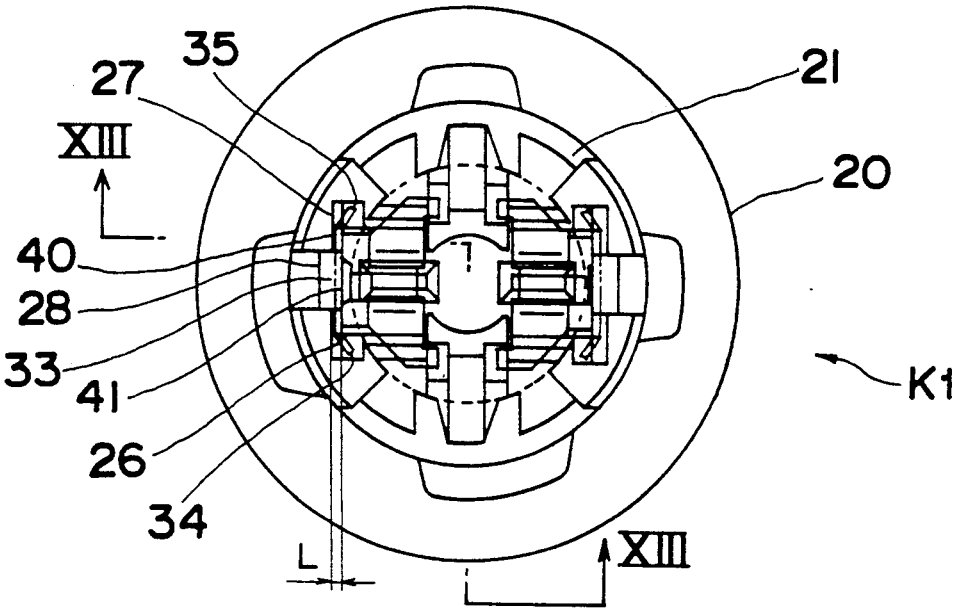
FIG. 12 is a top plan view of the socket of FIG. 7, into which a large bulb has been fitted.
Figure 13:
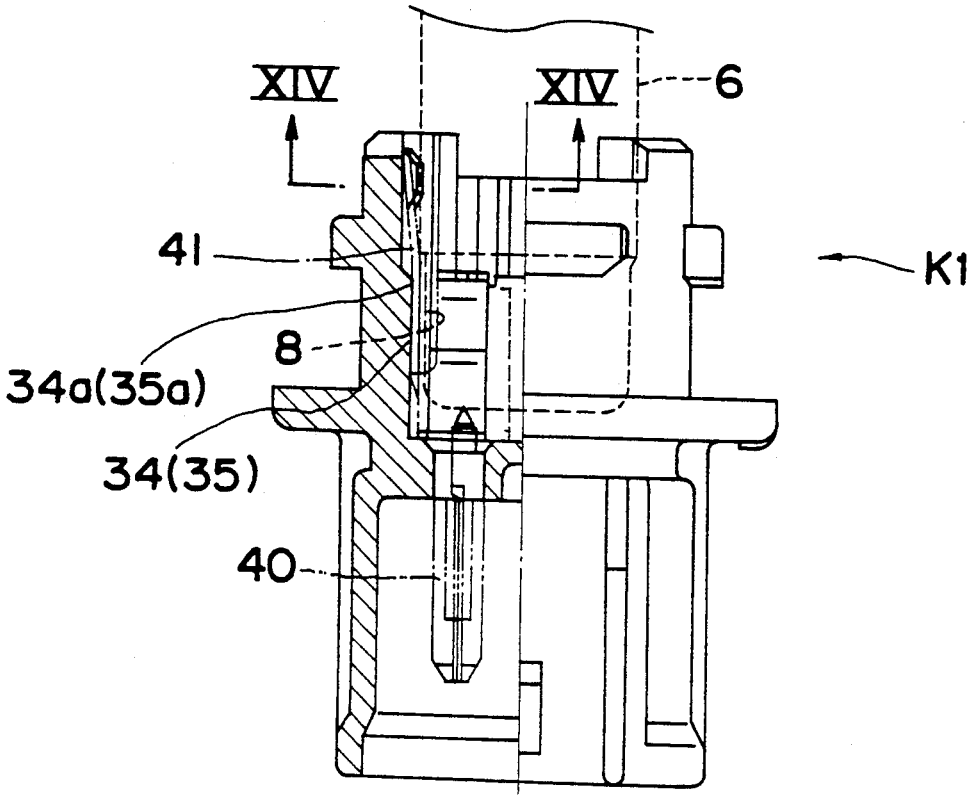
FIG. 13 is a sectional view taken along the line XIII—XIII in FIG. 12.
Figure 14:
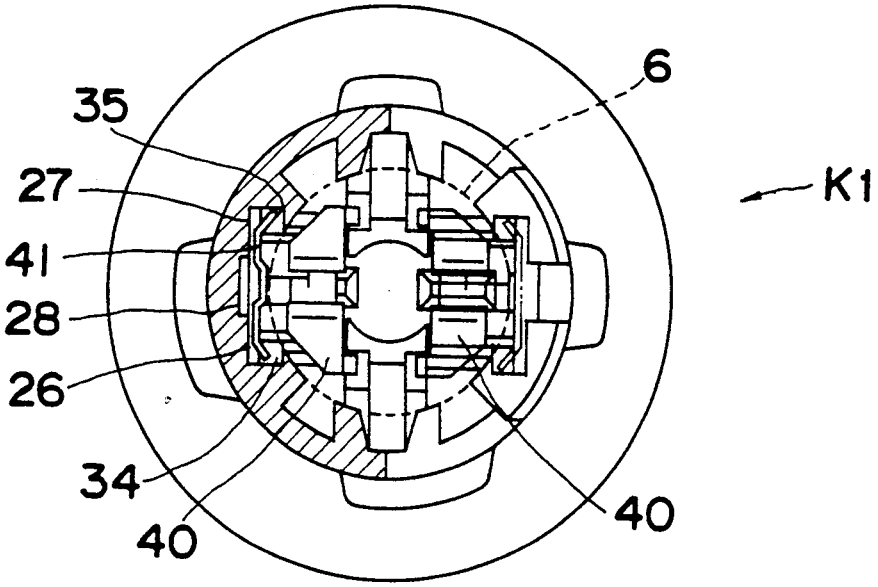
FIG. 14 is a sectional view taken along the line XIV—XIV in FIG. 13.
Figure 15:
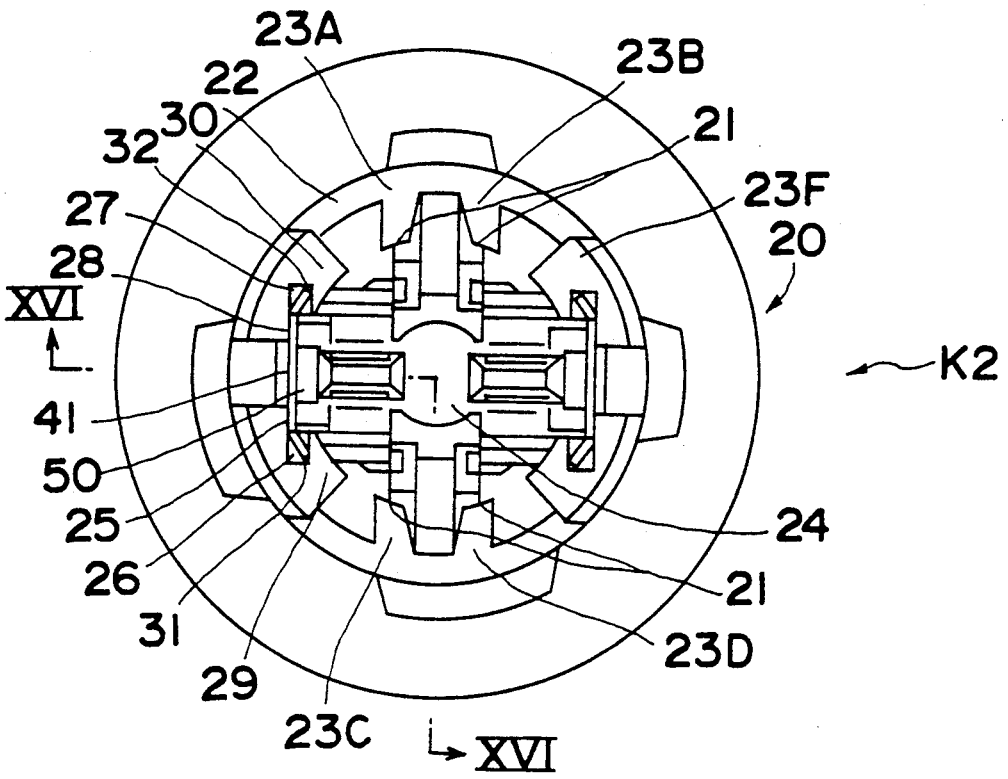
FIG. 15 is a top plan view of a socket according to a second embodiment of the present invention.
Figure 16:
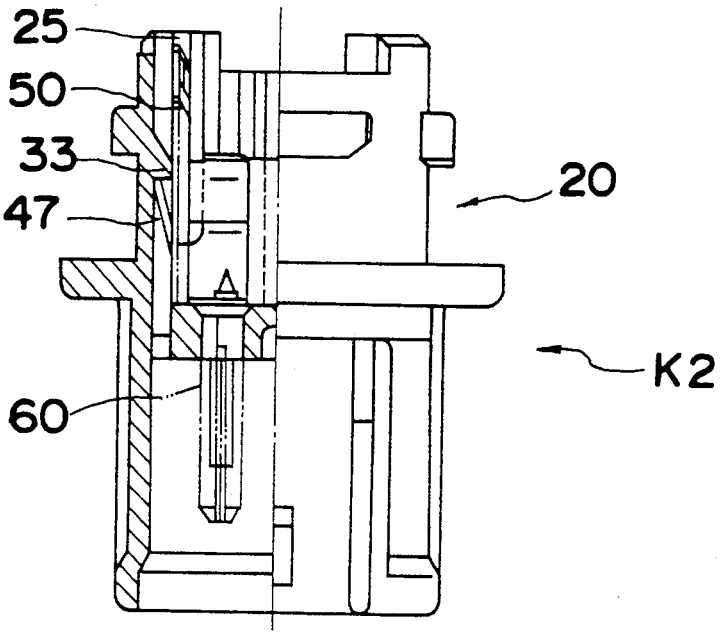
FIG. 16 is a sectional view taken along the line XVI—XVI in FIG. 15.

On the other hand, when the bulb 6 provided with the glass globe 7 having the outside diameter D1 larger than the minimum value of 9.60 mm but not more than the maximum value of 10.29 mm has been fitted into the socket body 20, the radially inner faces 21 of the ribs 23A to 23F are brought into contact with the outer peripheral surface of the bulb 6 as shown in FIG. 12. The outer edge of each of the base portions 8 of the bulb 6 brings the terminal 40 into close contact with the protrusion 33. Meanwhile, the mounting portion 41 is set in accordance with the minimum value of 9.60 mm in the outside diameter D1 of the glass globe 7 of the bulb 6 as described earlier, the outer peripheral surface of the glass globe 7 of the bulb 6 depresses the mounting portion 41 radially outwardly. Therefore, the upper portion of the mounting portion 41 is deflected radially outwardly by the glass globe 7 of the bulb 6 about fulcrums defined by the upper edges 34*a* and 35*a*, of the step portions 34 and 35 and thus, is brought into pressing contact with the outer peripheral surface of the glass globe 7 by a reaction force against deflection of the upper portion of the mounting portion 41. Namely, amount of deflection of the upper portion of the mounting portion 41 is so restricted as to fall within a distance L (FIG. 12) of a gap between the central portion 28 and the side portions 26 and 27. Within this distance L of the gap, the mounting portion 41 can be brought into pressing contact with the outer peripheral surface of the glass globe 7 by the reaction force against deflection of the upper portion of the mounting portion 41.

As is clear from the foregoing description of the first embodiment of the present invention, when the bulb provided with the glass globe having the minimum value of the outside diameter has been fitted into the socket body, the bulb is gripped by the terminals without deflection of the terminals. Therefore, even if vibrations are applied to a motor vehicle in which the bulb has been fitted into the socket body, looseness of the bulb can be eliminated. As a result, not only reliability of electrical contact between the bulb and the terminals can be improved but detachment of the bulb from the socket body can be prevented positively.

On the contrary, when the bulb provided with the glass globe having the outside diameter larger than the minimum value has been fitted into the socket body, the upper portion of the terminal is deflected by the glass globe of the bulb about the fulcrums defined by the upper edges of the step portions of the slot formed in the socket body, so that the glass globe is gripped by the upper portion of the terminal. Therefore, even the large bulb can be closely held by the terminals. Accordingly, also in the case of the large bulb, reliability of electrical contact between the bulb and the terminals can be upgraded and detachment of the bulb from the socket body can be prevented securely in the same manner as the small bulb.

Referring to FIGS. 15 to 22, there is shown a socket K2 according to a second embodiment of the present invention. In the socket K2, the terminal 40 of the socket K1 is replaced by a terminal 60 as shown in FIGS. 17 and 18. In the terminal 60, a rectangular elastic piece 50 is cut and bent obliquely downwardly from an upper central portion of the mounting portion 41 so as to project in the same direction as the lugs 42 such that an upper end of the elastic piece 50 is coupled with the mounting portion 41. The elastic piece 50 has a function of eliminating looseness of the bulb 6 fitted into the socket body 20 and has such elasticity as to be deformed about a fulcrum defined by the upper end of the elastic piece 50. A distance of projection of the elastic piece 50, i.e. a distance between a lower end of the elastic piece 50 and the mounting portion 41 is preset such that the bulb 6 provided with the glass globe 7 having the minimum value of 9.60 mm in the outside diameter D1 is gripped between the opposed elastic pieces 50 through pressing contact of the bulb 6 with the elastic pieces 50. Meanwhile, when the lugs 42 of the terminal 60 are engaged with the cavities 31 and 32, the mounting portion 41 is held in contact with the peripheral surface of the slot 25.

Since other constructions of the socket K2 are similar to those of the socket K1, description thereof is abbreviated for the sake of brevity.

Figure 19:
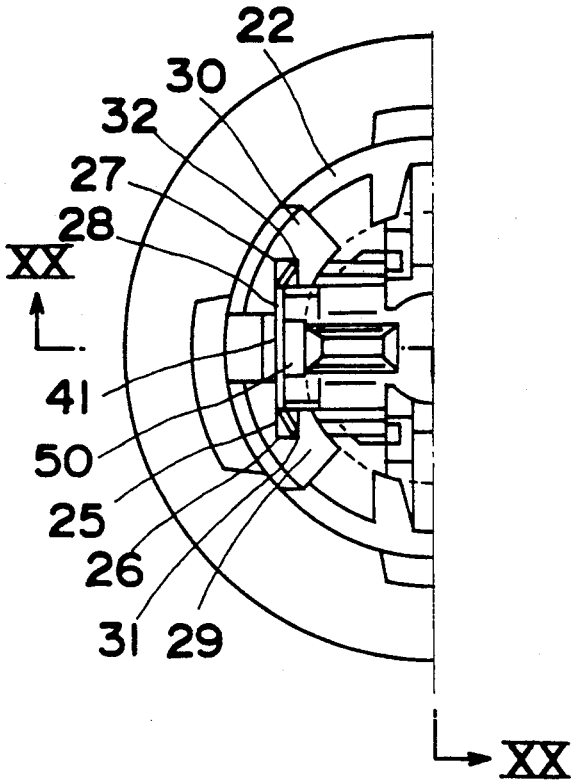
FIG. 19 is a top plan view of the socket of FIG. 15, into which a small bulb has been fitted.
Figure 20:
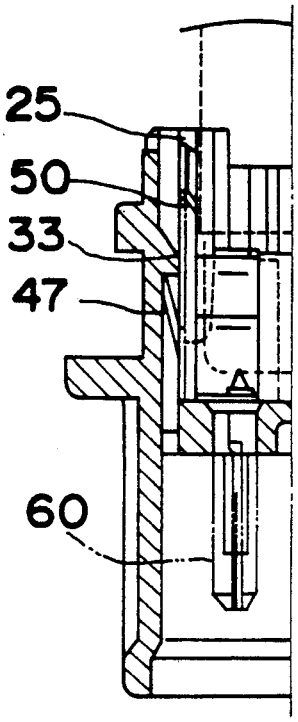
FIG. 20 is a sectional view taken along the line XX—XX in FIG. 19.

By the above described arrangement of the socket K2, when the bulb 6 provided with the glass globe 7 having the minimum value of 9.60 mm in the outside diameter D1 is fitted into the socket body 20, the elastic piece 50 of each of the terminals 60 is brought into contact with the outer peripheral surface of the glass globe 7 of the bulb 6 as shown in FIGS. 19 and 20. Therefore, the bulb 6 is closely gripped by the opposed elastic pieces 50 of the terminals 60.

Figure 21:
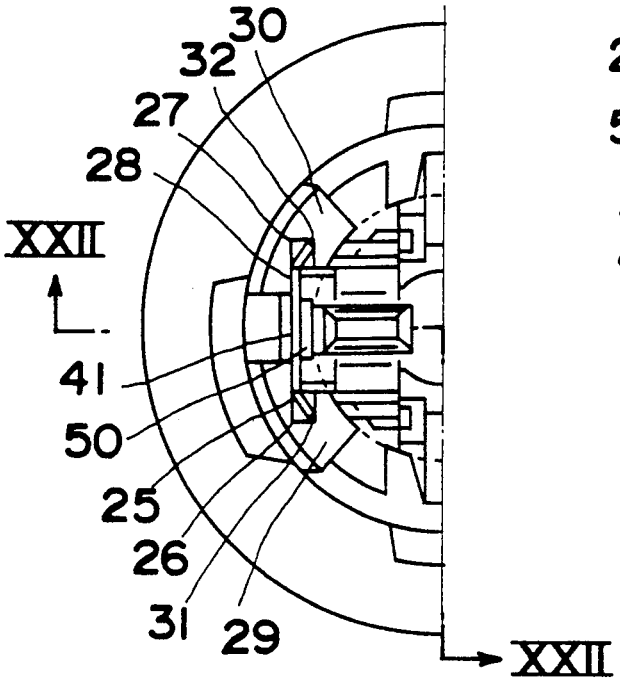
FIG. 21 is a top plan view of the socket of FIG. 15, into which a large bulb has been fitted.
Figure 22:
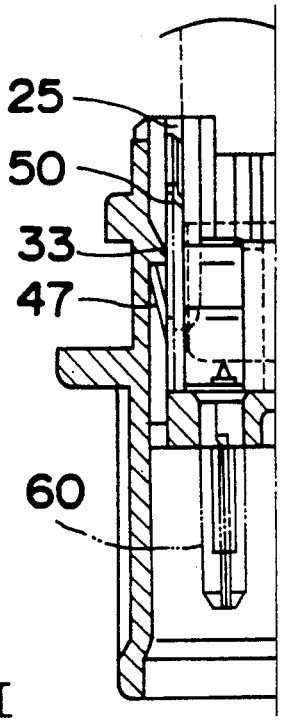
FIG. 22 is a sectional view taken along the line XXII—XXII in FIG. 21.

On the other hand, when the bulb 6 provided with the glass globe 7 having the outside diameter D1 larger than the minimum value of 9.60 mm but not more than the maximum value of 10.29 mm is fitted into the the socket body 20, the elastic piece 50 of each of the terminals 50 is depressed by the outer peripheral surface of the glass globe 7 of the bulb 6 as shown in FIGS. 21 and 22 such that a lower portion of the elastic piece 50 is deflected radially outwardly. As a result, since the opposed elastic pieces 50 of the terminals 60 are brought into pressing contact with the bulb 6, the bulb 6 is closely gripped by the elastic pieces 50 of the terminals 60.

Figure 25:
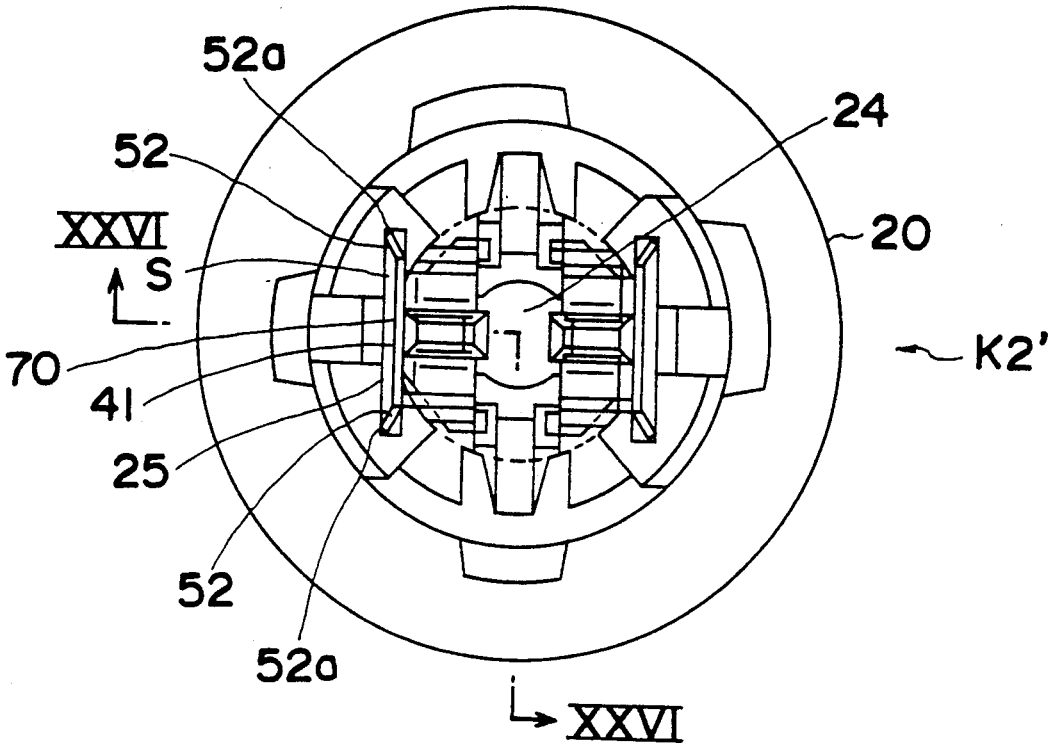
FIG. 25 is a top plan view of the socket of FIG. 23, into which a bulb having a minimum size has been fitted.
Figure 26:
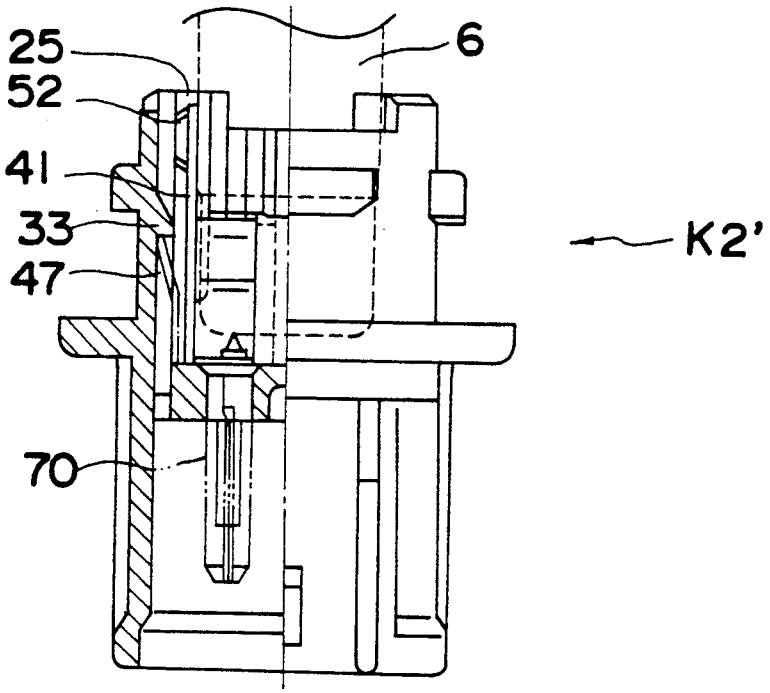
FIG. 26 is a sectional view taken along the line XXVI—XXVI in FIG. 25.

FIGS. 23 to 28 show a socket K2' which is a modification of the socket K2. In the socket K2', the socket body 20 is structurally similar to that of the socket K2 and the terminal 60 of the socket K2 is replaced by a terminal 70. In the terminal 70, the elastic piece 50 of the terminal 60 is eliminated and the lugs 42 of the terminal 60 are replaced by a pair of lugs 52 projecting in the same direction as the stopper 47. The lugs 52 are provided for eliminating looseness of the bulb 6 fitted into the socket body 20 and each have a distal end 52*a*. As shown in FIGS. 25 and 26, the distal end 52*a* of each of the lugs 52 is retained at each of opposite corners of the peripheral surface of the slot 25 of the socket body 20 and thus, the mounting portion 41 of the terminal 70 is spaced a clearance S from the peripheral surface of the slot 25. In this preset state of the terminal 70, since the mounting portion 40 is positioned in accordance with the minimum value of 9.60 mm in the outside diameter D1 of the glass globe 7 of the bulb 6, a radially inner face of the mounting portion 41 is brought into contact with the outer peripheral surface of the glass globe 7 having the minimum value of 9.60 mm in the outside diameter D1 so as to hold the glass globe 7.

In the socket K2,, when the bulb 6 provided with the glass globe 7 having the minimum value of 9.60 mm in the outside diameter D1 has been fitted into the socket body 20, the glass globe 7 of the bulb 6 is closely gripped between the opposed mounting portions 41 of the terminals 70 as shown in FIGS. 25 and 26.

Figure 27:
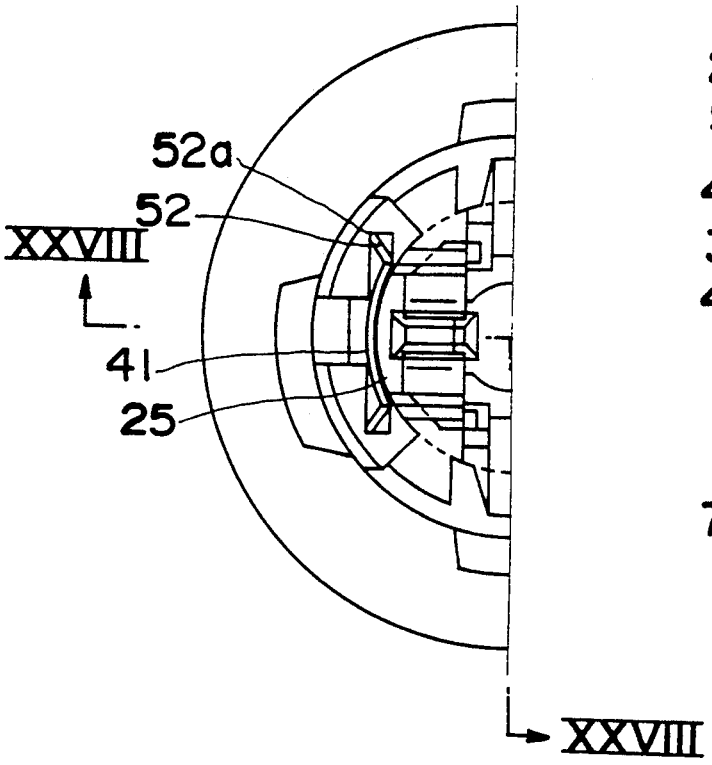
FIG. 27 is a top plan view of the socket of FIG. 23, into which a bulb having a maximum size has been fitted.
Figure 28:
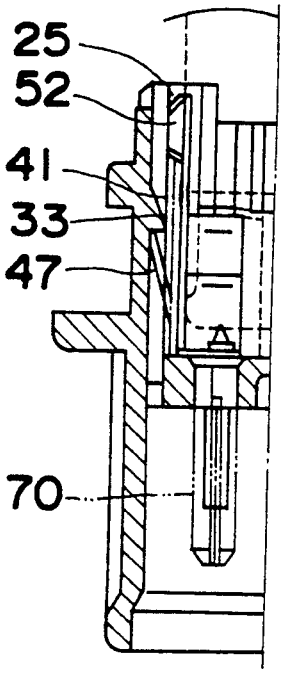
FIG. 28 is a sectional view taken along the line XXVIII—XXVIII in FIG. 27.

On the other hand, when the bulb 6 provided with the glass globe 7 having the outside diameter D1 larger than the minimum value of 9.60 mm has been fitted into the socket body 20, the mounting portion 41 of the terminal 70 is depressed radially outwardly by the glass globe 7 of the bulb 6 so as to be curved radially outwardly as shown in FIGS. 27 and 28. At this time, the clearance S formed between the mounting portion 41 and the peripheral surface of the slot 25 enables the mounting portion 41 to be curved radially outwardly. Since the mounting portion 51 is brought into pressing contact with the glass globe 7 while being curved radially outwardly, the glass globe 7 is closely gripped by the mounting portions 51.

As will be seen from the foregoing description of the second embodiment of the present invention, the member for eliminating looseness of the bulb is set in accordance with the minimum value of the outside diameter of the glass globe of the bulb. When the bulb provided with the glass globe having an outside diameter larger than the minimum value has been fitted into the socket body, the looseness eliminating member itself or the mounting portion of the terminal is depressed by the glass globe so as to be deflected radially outwardly. Therefore, the bulb provided with the glass globe having the outside diameter from the minimum value to the maximum value can be held in the socket body without looseness. Accordingly, even if vibrations are applied to the motor vehicle in which the bulb has been fitted into the socket body, looseness of the bulb in the socket body can be eliminated. Consequently, reliability of electrical contact between the bulb and the terminals can be upgraded and detachment of the bulb from the socket body can be prevented positively.

Figure 29:
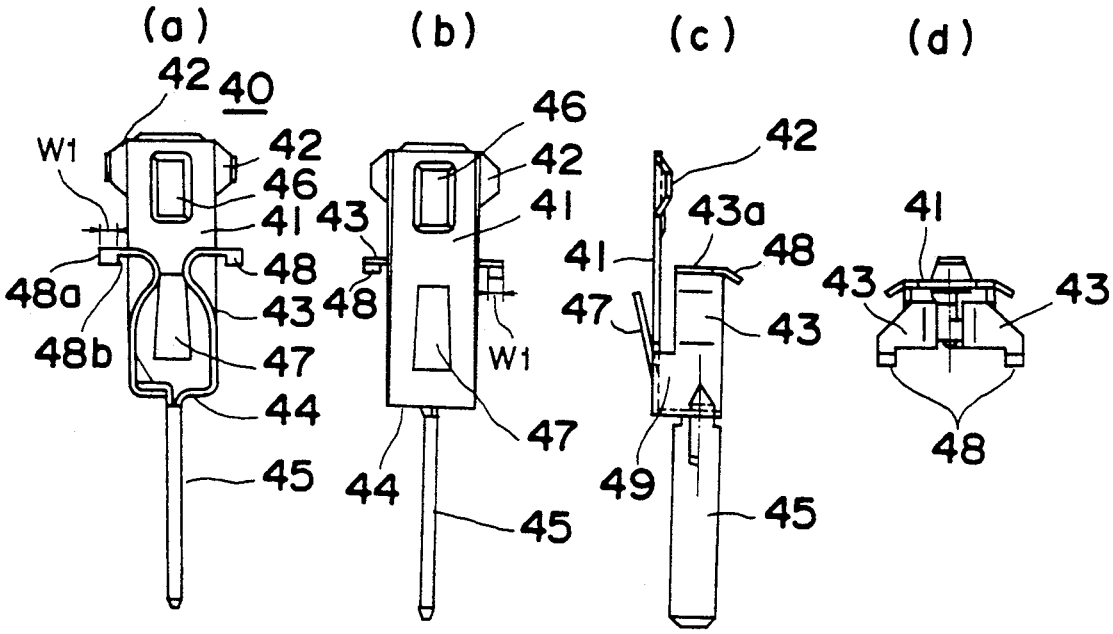
FIGS. 29(*a*), 29(*b*), 29(*c*) and 29(*d*) are a front elevational, a rear elevational, a side elevational and a top plan view of a terminal of a socket according to a third embodiment of the present invention, respectively.

Referring further to FIGS. 29 to 33, there is shown a socket K3 according to a third embodiment of the present invention. In the socket K3, the socket body 20 of the socket K1 is replaced by a socket body 80, while the terminal 40 of FIG. 10 is employed as in the socket K1. More specifically, the projection 48 of each of the contact pieces 43 of the terminal 40 has left and right edges 48*a* and 48*b* and a width W1 between the left and right edges 48*a* and 48*b* as shown in FIG. 29. As shown in FIG. 29(*c*), the projection 48 is bent downwardly at one side of the distal end portion 43*a* of the contact piece 43 remote from the mounting portion 41 so as to be oriented towards the axis of the socket body 80 when the terminal 40 has been mounted in the socket body 80.

Figure 30:
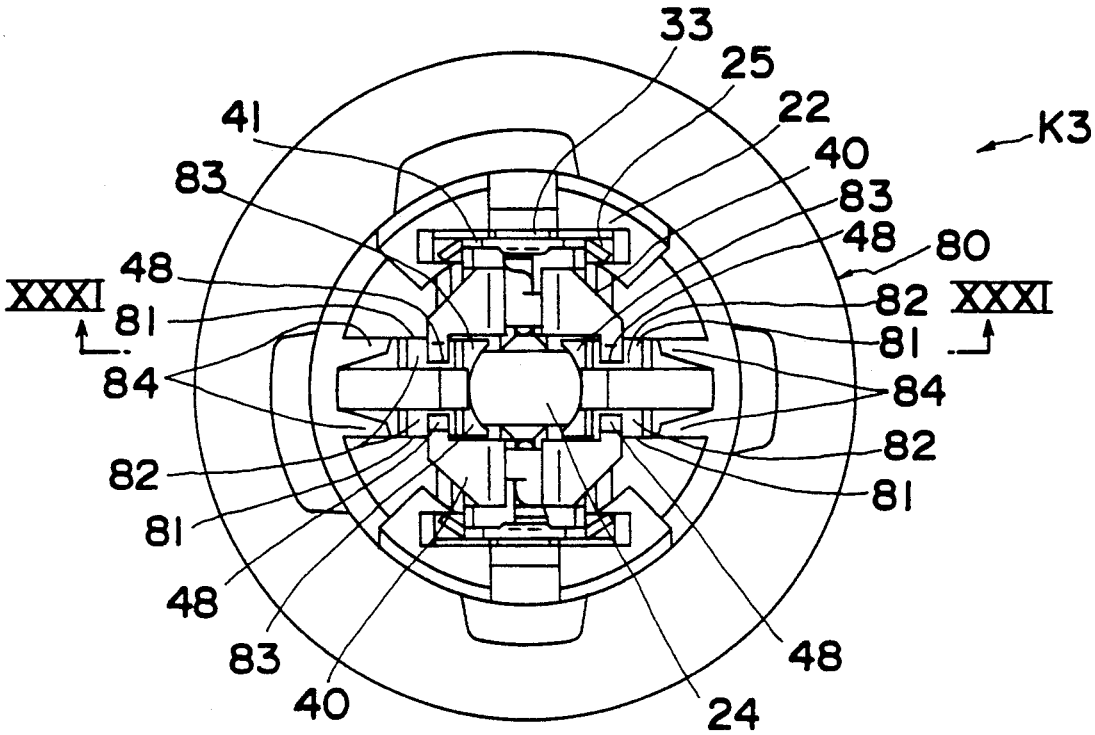
FIG. 30 is a top plan view of the socket of FIG. 29.
Figure 31:
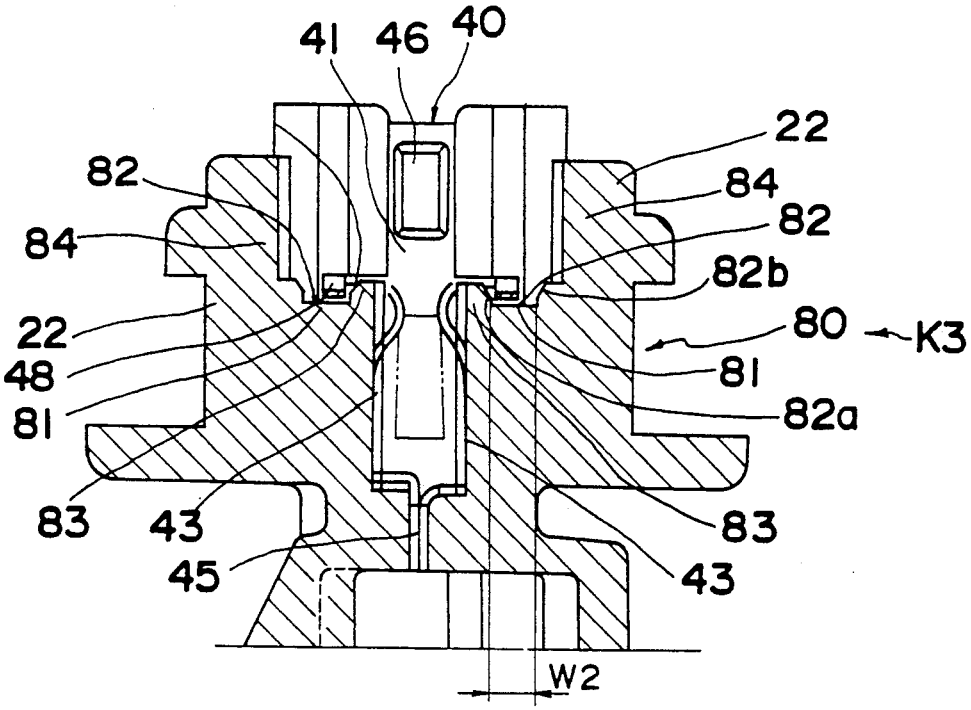
FIG. 31 is a sectional view taken along the line XXXI—XXXI in FIG. 30.

As shown in FIGS. 30 and 31, a pair of parallel walls 81 confront each other in the opening 24 so as to support the contact pieces 43 of each of the terminals 40. A recess 82 having left and right edges 82*a* and 82*b* is formed on an upper face of each of the parallel walls 81 so as to be engaged with the projection 48 of each of the contact pieces 43 such that the recesses 82 of the parallel walls 81 are disposed symmetrically with respect to the axis of the opening 24. A pair of cylindrical wall portions 83 confront each other in the opening 24 so as to receive the stem 9 of the bulb 6, while a pair of ribs 84 project radially inwardly from the inner face of the circumferential wall 22 so as to confront another pair of the ribs 84. Each of the parallel walls 81 is disposed between each of the cylindrical wall portions 83 and each of the ribs 84.

As shown in FIG. 31, the left and right edges 82*a* and 82*b* of the recess 82 are inclined laterally outwardly and a width W2 of a bottom face of the recess 82*b* is so set as to be larger than the width W1 of the projection 48 of the terminal 40. Therefore, when the projection 48 of each of the contact pieces 43 of the terminal 40 is displaced laterally, either one of the left and right edges 48*a* and 48*b* of the projection 48 is brought into contact with a corresponding one of the left and right edges 82*a* and 82*b* of the recess 82. Meanwhile, the width W2 of the recess 82 is set to such a value that the projection 48 of the terminal 40 can be restored to its original shape after having been deflected in the recess 82.

Figure 32:
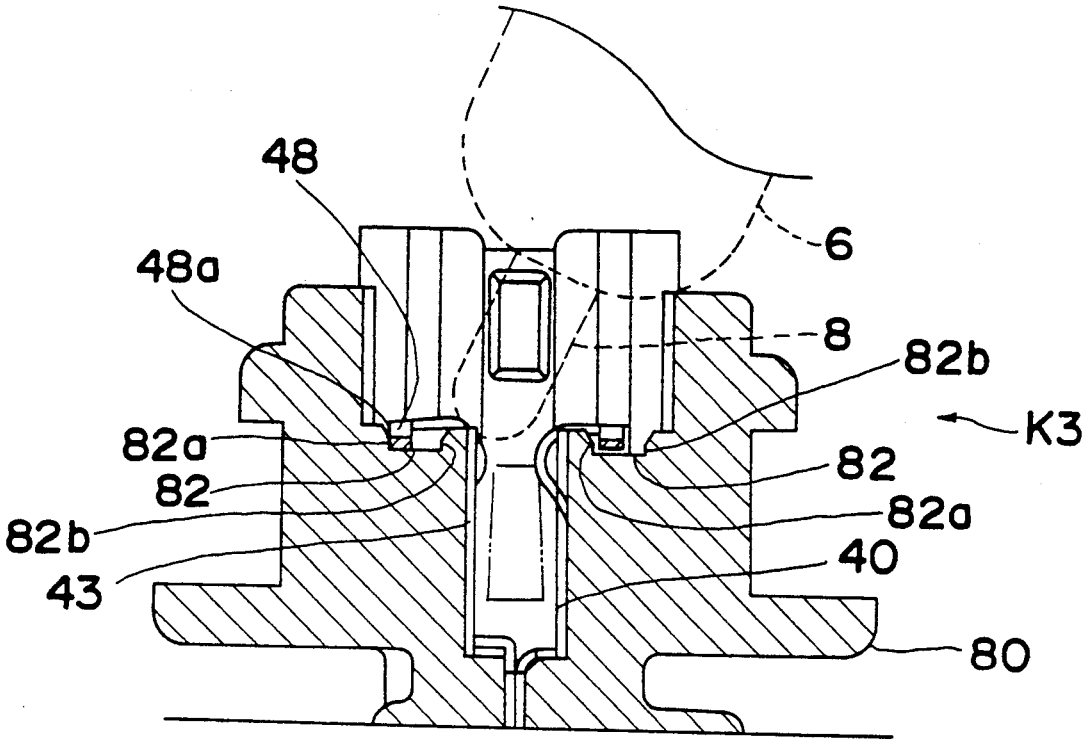
FIGS. 32 and 33 are sectional views of the socket of FIG. 29, explanatory of operation of the socket in the case of oblique insertion of a bulb thereinto.

As described above, since the projection 48 is provided at the distal end portion 43*a* of each of the contact pieces 43 of the terminal 40 and the recess 82 engageable with the projection 48 is formed on the socket body 80, deformation of the terminal 40 can be restrained. For example, when the bulb 6 is obliquely inserted into the socket body 80 in a leftward direction and a distal end of the base portions 8 is brought into contact with the distal end portion 43a of the left contact piece 43 of the terminal 40 as shown in FIG. 32, the left contact piece 43 is so deformed as to be inclined leftwards outwardly. At this time, the left edge 48a of the left projection 48 is brought into the left edge 82a of the left recess 82 and thus, further displacement of the left projection 48, i.e. further deformation of the left contact piece 43 is prevented. Meanwhile, at the same time, the left edge 48a of the right projection 48 is also brought into contact with the left edge 82a of the right recess 82 such that deformation of the terminal 40 is prevented.

Figure 33:
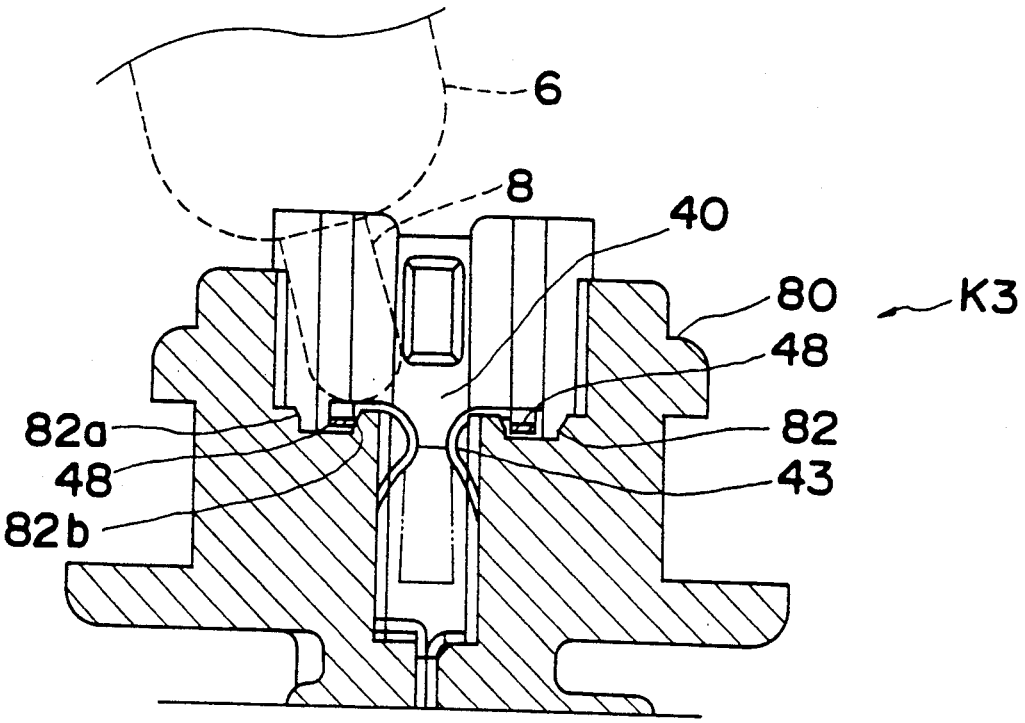

On the other hand, when the bulb 6 is obliquely inserted into the socket body 80 in a rightward direction as shown in FIG. 33, the right edge 48a of the left projection 48 is brought into contact with the right edge 82b of the left recess 82 such that deformation of the terminal 40 is restrained.

Figure 34:
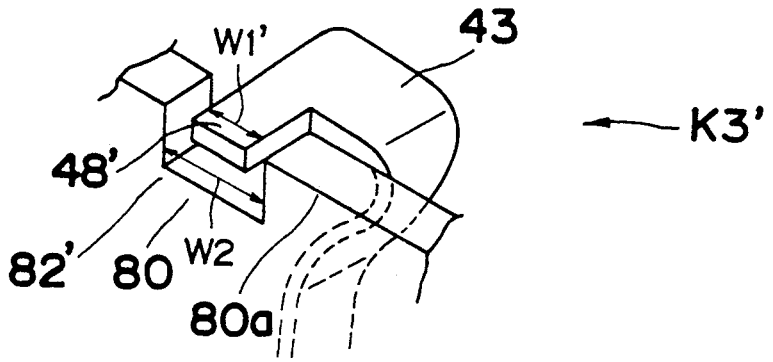
FIG. 34 is a fragmentary perspective view of a socket which is a first modification of the socket of FIG. 29.

FIG. 34 shows a socket K3′ which is a first modification of the socket K3. In the socket K3′, the projection 48 of the terminal 40 and the recess 82 of the socket body 80 is replaced by a projection 48′ and a recess 82′, respectively. In the socket K3, when the terminal 40 has been mounted in the socket body 80, the projection 48 of the contact piece 43 of the terminal 40 is bent downwardly towards the axis of the socket body 80. On the other hand, in the socket K3′, when the terminal 40 has been mounted in the socket body 80, the projection 48′ of the contact piece 43 is bent horizontally towards the axis of the socket body. Thus, the recess 82′ for receiving the projection 48′ is formed on an upper face of each of the parallel walls 81 so as to be smaller in depth than the recess 82 such that the projection 48, is engaged in the recess 82′. Meanwhile, a width W1′ of the projection 48′ is so set as to be smaller than the width W1 of the projection 48 by a predetermined value. Since other constructions of the socket K3, are similar to those of the socket K3, description thereof is abbreviated for the sake of brevity.

Figure 35:
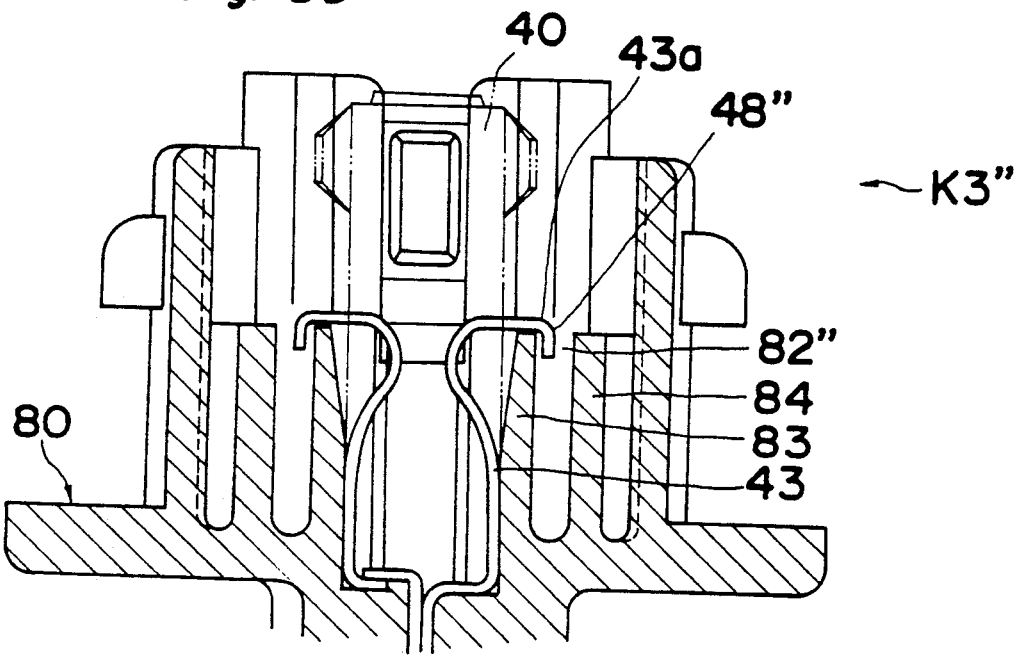
FIG. 35 is a view similar to FIG. 31, particularly showing a second modification thereof.
Figure 36:
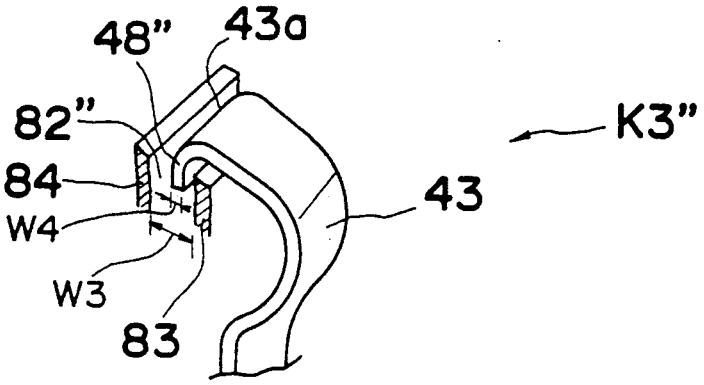
FIG. 36 is a fragmentary perspective view of the socket of FIG. 35.

FIGS. 35 and 36 show a socket K3″ which is a second modification of the socket K3. In the socket K3″, a projection 48″ of the contact piece 43 of the terminal 40 is bent downwardly from the distal end portion 43a and the recess 82 formed on the upper face of each of the parallel walls 81 in the socket K3 is replaced by a gap 82″ defined between the cylindrical wall portion 83 and the rib 84. A width W3 of the gap 82″ is so set as to be larger than a width W4 of the projection 48″ by a predetermined value. Since other constructions of the socket K3″ are similar to those of the socket K3, description thereof is abbreviated for the sake of brevity.

In the third embodiment of the present invention, since the contact piece of the terminal is provided with the projection and the engageable portion for loosely receiving the projection is formed on the socket body, it is possible to prevent deformation of the terminal 40 due to oblique insertion of the bulb 6 into the socket body. Furthermore, in case the terminal 40 has been deformed during its storage or transportation, the projection 48 of the terminal 40 is not inserted into the recess 82 of the socket body 80 and thus, it becomes possible to detect the defective terminal 40 at the time of its insertion into the socket body 80.

As is clear from the foregoing description of the third embodiment of the present invention, deformation of the terminal due to improper insertion of the bulb into the socket body can be prevented positively by the quite simple arrangement in which the projection is formed at the distal end portion of the contact piece of the terminal and the engageable portion for receiving the projection is formed on the socket body. Since deformation of the terminal can be prevented as described above, reliable contact between the terminal and the lead wire can be secured. In addition, since it is not necessary to give attention to deformation of the terminal at the time of insertion of the bulb into the socket body, efficiency of operation for inserting the bulb into the socket body can be improved greatly.

What is claimed is:

1. A socket for a wedge base bulb, in which a cylindrical socket body has an opening for receiving the bulb and a terminal having a pair of opposed contact pieces is mounted in the opening and the contact pieces grip a base portion of the bulb therebetween so as to be electrically connected to the base portion, the improvement comprising:

a slot for receiving a rectangular platelike mounting portion of the terminal, which is formed on an inner face of a circumferential wall of the socket body so as to confront the opening;

a step portion which projects radially inwardly from a location on the inner face of the circumferential wall in the slot;

the location, when an axis of the socket body extends in a vertical direction such that the opening is disposed at an upper portion of the socket body, being axially spaced from an upper end of the circumferential wall such that the step portion confronts a lower portion of the terminal mounting portion when the mounting portion has been fitted into the slot;

wherein when the bulb has a minimum size, the bulb is supported by the lower portion of the mounting portion of the terminal; and wherein when the bulb has a maximum size, an upper portion of the mounting portion of the terminal is deflected radially outwardly by the bulb about a fulcrum defined by an upper edge of the step portion of the slot so as to grip the bulb.

2. A socket for a wedge base bulb, in which a cylindrical socket body has an opening for receiving each of two distinct size bulbs and a terminal having a pair of opposed contact pieces is mounted in the opening and the contact pieces grip a base portion of the bulb therebetween so as to be electrically connected to the base portion, the improvement comprising:

a slot for receiving a rectangular platelike mounting portion of the terminal, which is formed on an inner face of a circumferential wall of the socket body so as to confront the opening;

an elastic member for eliminating looseness of the bulb fitted into the opening, which is projected from the mounting portion of the terminal and is preset in accordance with a minimum size of the bulb; and wherein the elastic member is deflected in accordance with size of the bulb fitted into the opening so as to closely grip the bulb in the socket body.

3. A socket as claimed in claim 2, wherein the elastic member is formed by a piece cut at a central portion of the mounting portion of the terminal, the piece having a lower portion projecting towards an axis of the socket body such that the piece is deflected about a fulcrum defined by an upper end of the piece.

4. A socket as claimed in claim 2, wherein the elastic member is formed by a pair of lugs projecting from opposite sides of an upper portion of the mounting portion of the terminal in a direction away from an axis of the socket body such that a distal end of each of the lugs is retained at a peripheral surface of the slot of the socket body, wherein the lugs are so preset as to be brought into contact with the bulb having a small size, wherein when the bulb having a large size has been fitted into the opening, the mounting portion is deflected so as to be curved in the direction away from the axis of the socket body.

5. A socket for a wedge base bulb, in which a cylindrical socket body has an opening for receiving the bulb and a terminal having a pair of opposed contact pieces is mounted in the opening and the contact pieces grip a base portion of the bulb therebetween so as to be electrically connected to the base portion, the improvement comprising:

the contact pieces each having a distal end portion such that the distal end portions of the contact pieces extend in opposite outward directions, respectively;

a pair of projections which are bent from the distal end portions of the contact pieces, respectively;

the socket body being formed with a pair of engageable portions engageable with the projections, respectively such that each of the engageable portions has a width larger than that of each of the projections;

the projections each having opposite end faces in a direction of the width of each of the projections, while each of the engageable portions has opposed end faces in a direction of the width of each of the engageable portions; and wherein when each of the projections is inserted into each of the engageable portions, either one of the end faces of each of the projections is brought into contact with a corresponding one of the end faces of each of the engageable portions during displacement of the contact pieces of the terminal such that deformation of the terminal is restrained.

6. A socket as claimed in claim 5, wherein the projections of the terminal project towards each other on opposite sides of an axis of the socket body and each of the engageable portions is formed by a recess on an upper face of a wall of the socket body.

7. A socket as claimed in claim 5, wherein the projections of the terminal are formed by bending the distal end portions of the contact pieces downwardly and each of the engageable portions is formed by a gap defined between opposed walls of the socket body.

* * * * *